US008793892B2

(12) United States Patent
McLoughlin et al.

(10) Patent No.: US 8,793,892 B2
(45) Date of Patent: Aug. 5, 2014

(54) INDIVIDUAL GEAR DRYER SYSTEM

(75) Inventors: John E. McLoughlin, Hauppauge, NY (US); Neocles G. Athanasiades, E. Setauket, NY (US); Kiam Meng Toh, St James, NY (US)

(73) Assignee: ROM Acquisition Corporation, Belton, MO (US)

( * ) Notice: Subject to any disclaimer, the term of this patent is extended or adjusted under 35 U.S.C. 154(b) by 355 days.

(21) Appl. No.: 13/288,220

(22) Filed: Nov. 3, 2011

(65) Prior Publication Data

US 2013/0008045 A1 Jan. 10, 2013

Related U.S. Application Data

(63) Continuation-in-part of application No. 13/177,232, filed on Jul. 6, 2011.

(51) Int. Cl.
*F26B 19/00* (2006.01)

(52) U.S. Cl.
USPC ..... 34/105; 34/210; 34/218; D32/59; 211/182; 248/165

(58) Field of Classification Search
USPC ..... 34/90, 104, 105, 201, 210, 218; D32/8, D32/58, 59; 211/85.7, 182; 248/163.1, 165
See application file for complete search history.

(56) References Cited

U.S. PATENT DOCUMENTS

| | | | | |
|---|---|---|---|---|
| 1,558,572 | A * | 10/1925 | Badeaux | 34/106 |
| 3,154,392 | A * | 10/1964 | Littman | 34/104 |
| 3,299,529 | A * | 1/1967 | Roberts et al. | 34/104 |
| 3,577,650 | A * | 5/1971 | Brahm | 34/622 |
| 5,058,289 | A * | 10/1991 | Guindon | 34/104 |
| 5,289,642 | A * | 3/1994 | Sloan | 34/104 |
| 5,369,892 | A | 12/1994 | Dhaemers | |
| 5,377,849 | A * | 1/1995 | Martin | 211/85.7 |
| 5,412,928 | A * | 5/1995 | Reithel | 34/104 |
| 5,546,678 | A | 8/1996 | Dhaemers | |
| 5,592,750 | A * | 1/1997 | Eichten | 34/104 |
| 5,720,108 | A * | 2/1998 | Rice | 34/104 |
| 5,819,433 | A * | 10/1998 | Crooks | 34/104 |
| 6,516,536 | B2 * | 2/2003 | Ryden | 34/106 |
| 6,766,591 | B1 * | 7/2004 | McKinney et al. | 34/104 |
| 7,430,816 | B1 * | 10/2008 | Lozenski | 34/104 |
| 8,393,482 | B2 * | 3/2013 | Durham | 211/85.7 |
| 2001/0049883 | A1 * | 12/2001 | Ryden | 34/104 |
| 2004/0068888 | A1 * | 4/2004 | Lurie | 34/90 |
| 2005/0097768 | A1 | 5/2005 | Burns et al. | |
| 2005/0204579 | A1 * | 9/2005 | Rosseau et al. | 34/104 |

(Continued)

FOREIGN PATENT DOCUMENTS

| | | | | |
|---|---|---|---|---|
| CH | 670368 | A5 * | 6/1989 | A47K 10/48 |
| DE | 10221109 | A1 * | 11/2003 | A47K 10/06 |

(Continued)

*Primary Examiner* — Steve M Gravin
(74) *Attorney, Agent, or Firm* — Andrews Kurth LLP

(57) ABSTRACT

A dryer system for a firefighting ensemble comprising a housing having an air intake port and an air outlet port, a forced air assembly including a heater and a blower accommodated within the housing, a plurality of flexible porous hose segments coupled to the air outlet port operable to receive and conduct forced air therefrom, and the plurality of flexible porous hose segments are operable to conduct forced heated air into elements of the firefighting ensemble to speed drying.

9 Claims, 5 Drawing Sheets

(56) References Cited

U.S. PATENT DOCUMENTS

| | | | | |
|---|---|---|---|---|
| 2010/0270247 | A1 | 10/2010 | Durham | |
| 2012/0186098 | A1* | 7/2012 | Williams | 34/240 |
| 2013/0008044 | A1* | 1/2013 | McLoughlin et al. | 34/104 |
| 2013/0008045 | A1* | 1/2013 | McLoughlin et al. | 34/104 |
| 2013/0145641 | A1* | 6/2013 | McLoughlin et al. | 34/218 |
| 2013/0255099 | A1* | 10/2013 | Cavarretta et al. | 34/108 |

FOREIGN PATENT DOCUMENTS

| | | | | |
|---|---|---|---|---|
| EP | 11077 | A1 * | 5/1980 | E03D 9/08 |
| GB | 2139082 | A * | 11/1984 | A47L 11/38 |
| JP | 09135733 | A * | 5/1997 | A47B 61/04 |
| JP | 2010029439 | A * | 2/2010 | |
| WO | WO 9806315 | A2 * | 2/1998 | |

* cited by examiner

INDIVIDUAL GEAR DRYER SYSTEM

FIELD

The present disclosure relates to an individual gear dryer system. In particular, the present disclosure relates to a firefighter turnout gear or protective ensemble drying application.

BACKGROUND

Firefighting is a highly dangerous task that subjects firefighters to many hazards. An important asset to the firefighters is the turnout gear he wears while performing his duties. The turnout gear typically includes a coat, bunker pants, gloves, and boots, which are constructed of protective and fire-resistant materials. Because of the heavy materials and construction used, turnout gear that gets damp or wet while a firefighter is on duty is not easily ventilated and dried before the gear is needed again.

Perpetually damp and wet gear leads to many problems. Damp and wet gear promotes the growth of mildew and bacteria, which may lead to skin irritation, fungus, odor, and other more serious skin conditions. Moisture retained in the fabric may also cause premature wear, shorten the life expectancy, and compromise the thermal protective capability of the gear.

The National Fire Protection Association, Inc. (NFPA) has promulgated the standards for the selection, care, and maintenance of firefighting protective ensembles in publication NFPA 1851. Although NFPA 1851 specifies that air drying is the most appropriate method of drying firefighting ensemble elements, it does provide for the use of drying rooms in which the air is heated to no more than 100 degrees Fahrenheit. Conventional gear dryer systems employ rigid tubular racks onto which the gear may be hung. The tubular racks conduct and ventilate air into the gear to speed drying. Other conventional systems use a specially-outfitted cabinet that circulates air using ductwork and racks inside the cabinet. However, these conventional rack and cabinet systems are bulky, take up valuable space in the firehouse, and are expensive.

SUMMARY

An individual gear dryer system for firefighting gear and equipment and other applications is envisioned and described herein.

A dryer system for a firefighting ensemble comprising a housing having an air intake port and an air outlet port, a forced air assembly including a heater and a blower accommodated within the housing, a plurality of flexible porous hose segments coupled to the air outlet port operable to receive and conduct forced air therefrom, and the plurality of flexible porous hose segments are operable to conduct forced heated air into elements of the firefighting ensemble to speed drying.

A dryer system for an ensemble comprising a housing having an air intake port and an air outlet port, a forced air assembly accommodated within the housing, a plurality of flexible porous conducting elements coupled to the air outlet port operable to receive and conduct forced air therefrom, and the plurality of flexible porous conducting elements are operable to conduct forced air into elements of the ensemble to speed drying.

A portable dryer system comprising a forced air assembly including a heater and a blower, a plurality of flexible porous hose segments coupled to an air outlet of the forced air assembly and operable to receive and conduct forced air therefrom, and the plurality of flexible porous hose segments are operable to conduct forced heated air into articles of equipment to speed drying.

DETAILED DESCRIPTION

Figure 1A:
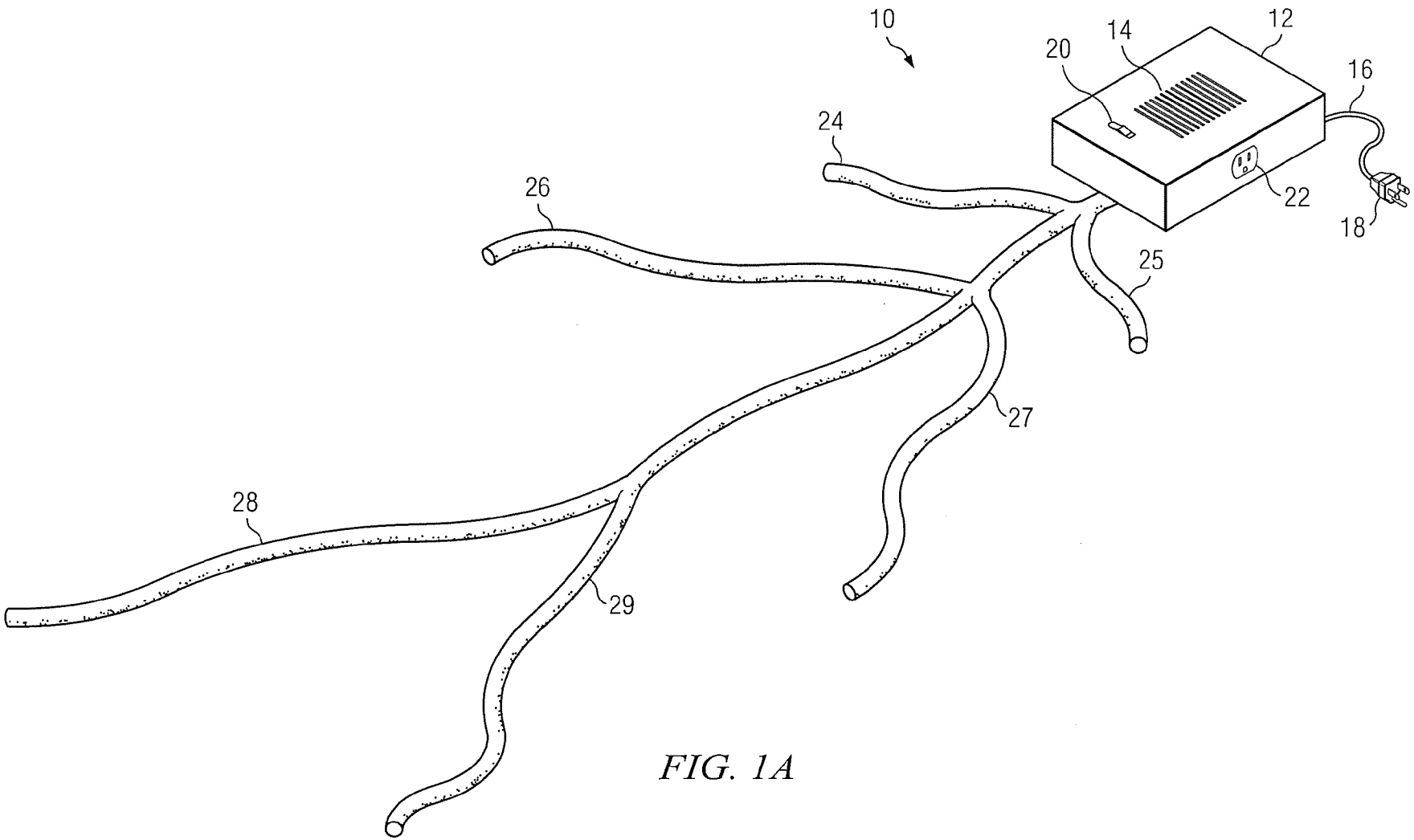
FIG. 1A is a perspective view of a first exemplary embodiment of an individual gear dryer system.

FIG. 1A is a perspective view of a first exemplary embodiment of an individual gear dryer system 10. System 10 includes a small blower assembly 12 within a housing enclosing an internal fan or blower (not explicitly shown) and internal heater (not explicitly shown). The housing may be constructed of metal or another appropriate material. The housing includes an air-intake opening 14 which may include a grate or screen to keep out debris and articles that may enter the housing and interfere with the operation of the blower and heater. The heater is operable to slightly warm the air such as about 10 degrees Fahrenheit above the ambient temperature. System 10 may be operated with the heater on or off to use forced ambient temperature air only. Further, system 10 includes a timer (not explicitly shown) that controls the duration the blower and heater operate. The timer may be pre-set to a default factory setting and/or may be manually adjustable to a certain time period by the user. System 10 further includes an electric cord 16 and plug 18 for powering the blower, heater, and timer. Alternatively, system 10 may be battery powered. An on/off switch 20 may be used to connect or disconnect power to the electrical circuitry in the system.

In a preferred embodiment, the housing of system 10 additionally includes an electrical outlet 22 that enables another individual gear dryer system or device to obtain power in situations where wall-mounted electrical outlets are scarce.

Coupled to the housing air outlet port is a plurality of interconnected porous flexible hose segments 24-29 that are operable to conduct the heated forced air from the blower and to release it along its lengths. One possible candidate for the porous flexible hose segments 24-29 may be the soaker hose used in gardening applications, for example. Conventional soaker hoses are made from rubber, polyethylene, and like materials. The porous flexible hose segments 24-29 are used to be threaded into the torso, sleeves, waist, pant legs, and boots of the turnout coat and pants to circulate heated air into the elements of the ensemble to speed drying. Hose segments 24-29 are coupled to an air outlet in the housing to receive and conduct forced heated air. The porosity of the hose segments enables the forced air to be distributed internally within the firefighting ensemble.

Figure 1B:
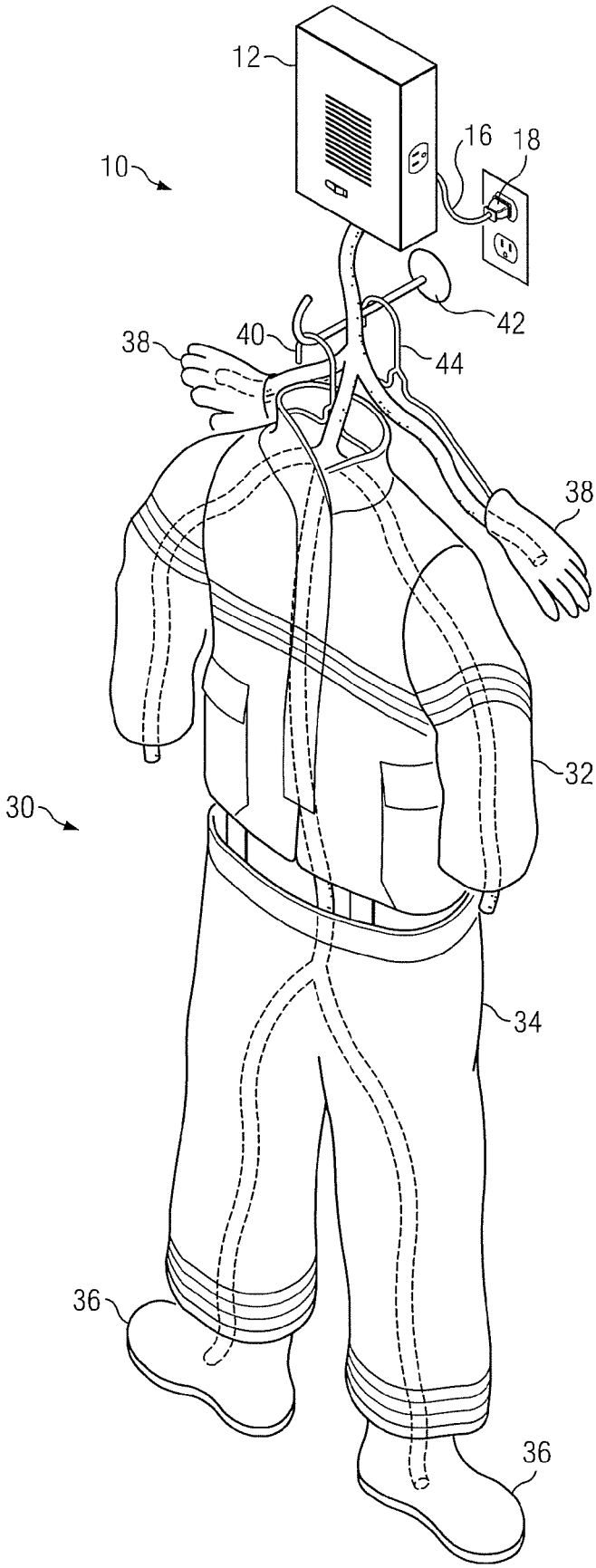
FIG. 1B is a perspective view of the first exemplary embodiment of an individual gear dryer system in operation.

FIG. 1B is a perspective view of the first exemplary embodiment of an individual gear dryer system being employed to dry firefighting turnout gear ensemble 30. Ensemble 30 typically includes a coat 32, bunker pants 34, boots 36, and gloves 38 that are ideally dried before the next use. As shown in FIG. 2, the ensemble elements 32-38 may be hung on a sturdy hanger 40 which is hung on a sturdy wall hook 42. Not explicitly shown are suspenders that are typically fastened to the bunker pants and enable them to be hung on the same hanger. As further shown in FIG. 2, the housing of system 10 may be fastened or hung on the wall near the wall hook, with the plurality of porous flexible hose segments 26-29 in the torso, sleeves, waist, pant legs, and boots of the ensemble elements 32 and 34. The ends of hose segments 28 and 29 are passed into boots 36 to help dry out the interior materials. Additionally, hose segments 24 and 25 may be used to force heated air into gloves 38 that may be hung on an additional hanger 44.

Figure 2A:
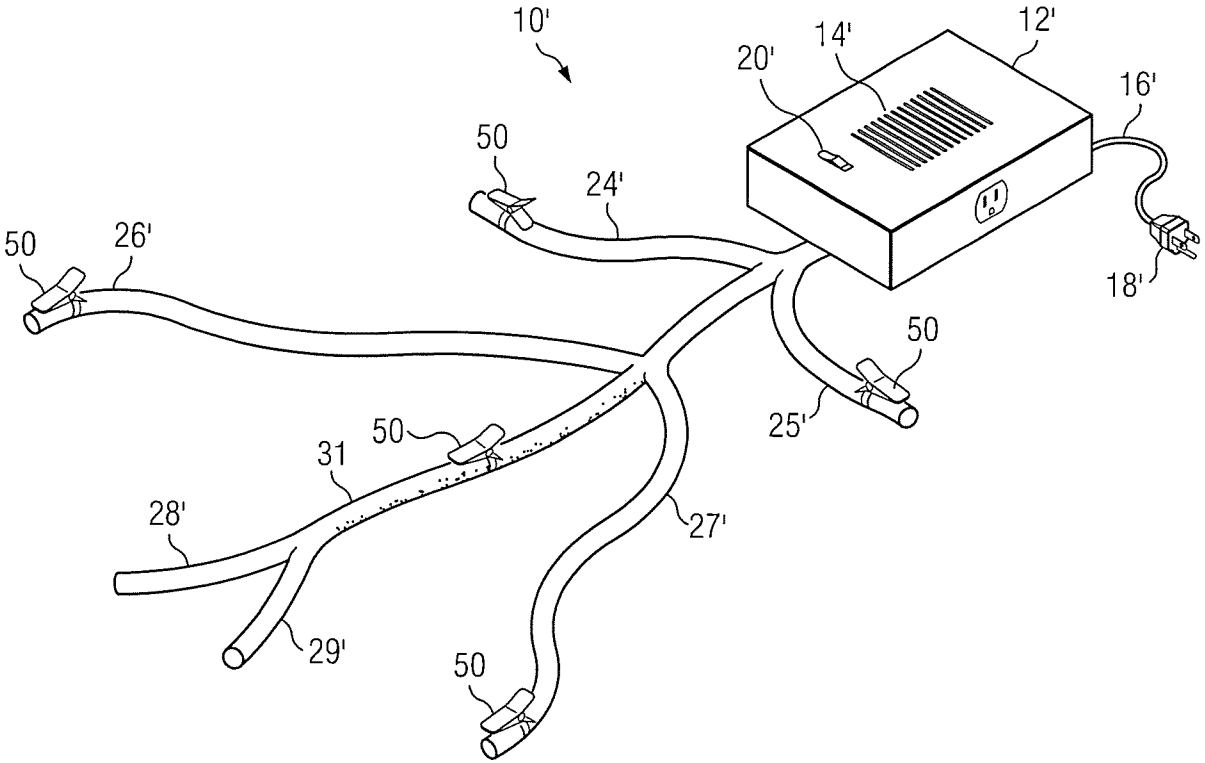
FIG. 2A is a perspective view of a second exemplary embodiment of an individual gear dryer system.
Figure 2B:
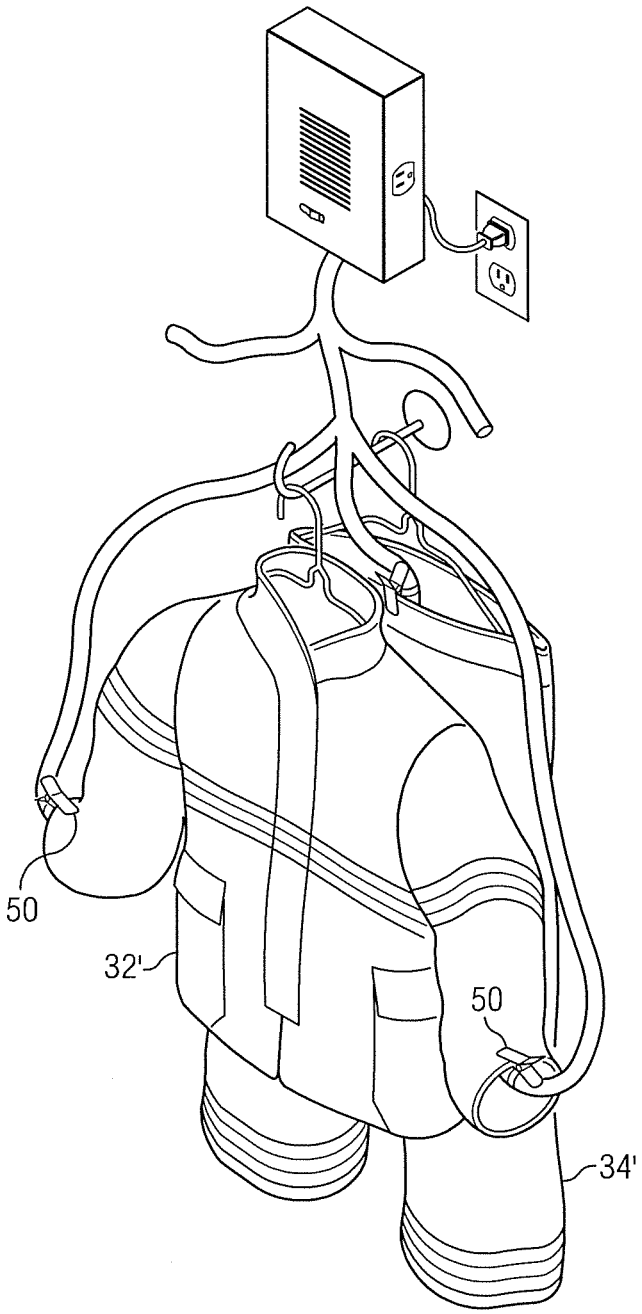
FIG. 2B is a perspective view of the second exemplary embodiment of an individual gear dryer system in operation.

FIG. 2A is a perspective view of a second exemplary embodiment of an individual gear dryer system 10' and FIG. 2B is a perspective view of the second exemplary embodiment in operation. System 10' is substantially similar to the system 10 described above and the description below focuses on the differences between the two embodiments. The system 10' also includes a plurality of interconnected flexible hose segments 24'-29', however, the hose segments are selectively porous. In other words, the hose segments 24'-29' may be porous to permit circulation of air in some selected sections, but not porous in other selected sections. For example, a central segment 31 of the hose segments, may be porous in a preferred embodiment to facilitate the drying of the torso portion of the turnout coat 32. Another significant difference of system 10' is that fasteners 50 are coupled to selected points of each hose segment 24'-29' to enable fastening of the hose segments to portions of the turnout coat and pants, gloves, and boots. The fasteners 50 may be clips, hook and loop tape, or another appropriate type of fastener that can be easily and securely fastened and unfastened to the firefighting gear. For example, the fasteners 50 of the hose segments 26' and 27' may be used to attach the hose segments to the sleeve openings of the turnout coat 32 to force air into the sleeves and torso of the turnout coat. Further, central segment 31 also has a fastener 50 that enables the hose segment 31 to be attached to the waistband of the pants and allows the hose segments 28' and 29' to extend and blow air into the pant legs.

Figure 3:
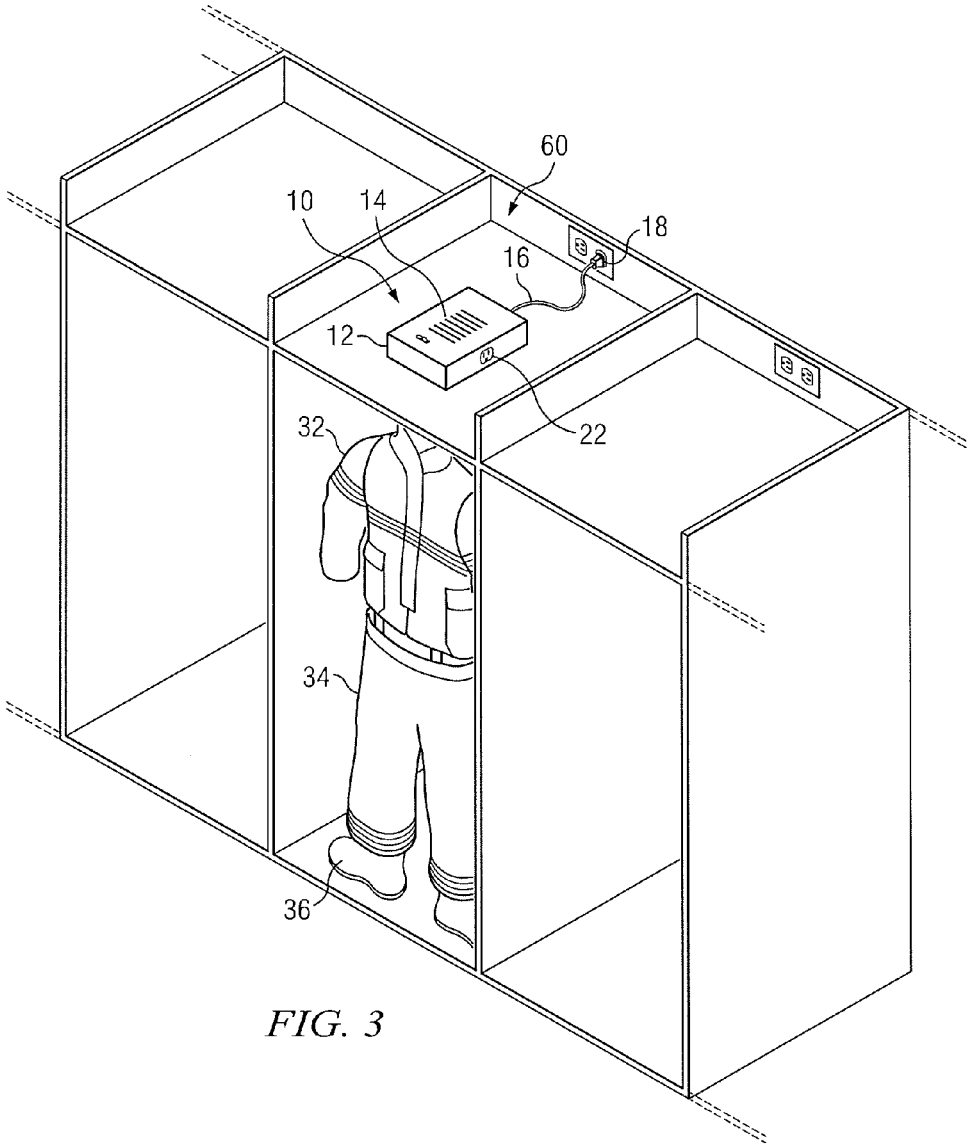
FIG. 3 is a an individual gear dryer system shown used in a typical cubicle.

FIG. 3 is a an individual gear dryer system 10 or 10' shown used in a typical cubicle 60. Cubicle 60 represents a conventional cubby, locker, cabinet, or shelving system that is used in many settings, including firehouses. Individual gear dryer system 10 may be used with such existing cubicles or cabinets in which firefighters may already hang and store their turnout gear. FIG. 3 shows an additional setup in which housing 12 of system 10 is positioned on a shelf above the cubicle so that it has easy access to fresh dry air outside of the cabinet. A small opening may be made on the shelf to enable the porous flexible hose segments to reach the ensemble elements hung below in the cubicle on a hook or hanger(s).

It should be noted that the individual dryer system described herein is not limited to the firefighting application. For example, this system may be used with scuba gear (e.g., wetsuit), waterskiing gear (e.g., swimwear and life jacket), snow sport gear (e.g., snowsuit, jacket, pants, boots, and gloves), boating gear, kayaking gear, and many other equipment and clothing that benefit from quicker drying time. Because a bulky specialized or custom rack system is not required, the individual dryer system may be easily ported and deployed anywhere.

The features of the present invention which are believed to be novel are set forth below with particularity in the appended claims. However, modifications, variations, and changes to the exemplary embodiments described above will be apparent to those skilled in the art, and the individual gear dryer system described herein thus encompasses such modifications, variations, and changes and are not limited to the specific embodiments described herein.

What is claimed is:

1. A dryer system for a firefighting ensemble comprising:

a housing having an air intake port and an air outlet port;

a forced air assembly including a heater and a blower accommodated within the housing;

a plurality of flexible porous hose segments coupled to the air outlet port operable to receive and conduct forced heated air therefrom, the hose segments being substantially porous along their entire lengths; and the plurality of flexible porous hose segments being placed inside elements of the firefighting ensemble and operable to conduct forced heated air into the elements of the firefighting ensemble to speed drying.

2. The dryer system of claim 1, further comprising a plurality of fasteners coupled to the plurality of flexible porous hose segments, adapted to fasten the plurality of flexible porous hose segments to the elements of the firefighting ensemble, to direct forced heated air into the elements of the firefighting ensemble.

3. The dryer system of claim 1, further comprising a plurality of clips coupled to the plurality of flexible porous hose segments, the clips adapted to fasten the plurality of flexible porous hose segments to the elements of the firefighting ensemble, to direct forced heated air into the sleeve openings of a turnout coat and pant legs of a pair of bunker pants.

4. The dryer system of claim 1, wherein the plurality of flexible porous hose segments are porous in selected sections thereof.

5. The dryer system of claim 1, wherein the forced air assembly further includes a timer.

6. The dryer system of claim 1, wherein the housing further includes an electrical outlet.

7. The dryer system of claim 1, wherein the plurality of flexible porous hose segments are placed inside a coat, coat sleeves, pant legs, and boots of the firefighting ensemble and operable to conduct forced heated air into the coat and coat sleeves, waist and pant legs of a pair of bunker pants, and a pair of boots.

8. The dryer system of claim 2, wherein the plurality of flexible porous hose segments are fastened to and placed inside a coat, coat sleeves, pant legs, boots, and gloves of the firefighting ensemble and operable to conduct forced heated air into sleeves and torso of a coat, waist and pant legs of a pair of bunker pants, a pair of boots, and a pair of gloves.

9. The dryer system of claim 1, wherein the heater is operable to heat air about 10 degrees Fahrenheit above the ambient air temperature.

* * * * *